US007670158B2

(12) United States Patent
Mori et al.

(10) Patent No.: US 7,670,158 B2
(45) Date of Patent: Mar. 2, 2010

(54) CONNECTOR ENGAGING STRUCTURE

(75) Inventors: Shigeo Mori, Makinohara (JP); Tsuyoshi Mizushima, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/061,724

(22) Filed: Apr. 3, 2008

(65) Prior Publication Data

US 2008/0261434 A1 Oct. 23, 2008

(30) Foreign Application Priority Data

Apr. 18, 2007 (JP) ..... 2007-109618

(51) Int. Cl.
*H01R 13/62* (2006.01)

(52) U.S. Cl. ..... 439/157; 439/372

(58) Field of Classification Search ..... 439/157, 439/372

See application file for complete search history.

(56) References Cited

U.S. PATENT DOCUMENTS 5,463,912 A * 11/1995 Inoue et al. ..... 74/519
5,499,926 A * 3/1996 Akeda ..... 439/157
5,681,175 A * 10/1997 Busse et al. ..... 439/157
6,120,308 A * 9/2000 Hayashi ..... 439/157
6,146,162 A * 11/2000 Okabe ..... 439/157

FOREIGN PATENT DOCUMENTS

JP 2000-82548 A 3/2000
JP 2005-209511 A 8/2005

* cited by examiner

*Primary Examiner*—Javaid Nasri
(74) *Attorney, Agent, or Firm*—Sughrue Mion, PLLC

(57) ABSTRACT

A connector engaging structure includes an electrical connection box including a first connector provided with a connecting terminal, a second connector to be engaged with the first connecter, and provided with a mating terminal to be connected to the connecting terminal, an outer housing which houses a whole of the second connector, and is secured to the electrical connection box, and a rotatable lever which couples the second connector with the outer housing, and relatively moves the second connector to/from the first connector to connect/disconnect the connecting terminal to/from the mating terminal.

12 Claims, 7 Drawing Sheets

CONNECTOR ENGAGING STRUCTURE

BACKGROUND OF THE INVENTION

The present invention relates to a connector engaging structure, and more particularly, to the connector engaging structure which is favorably used for temporarily breaking a circuit current, on occasion of conducting inspection and maintenance of an electric car or a hybrid car which has a high voltage circuit for driving a motor.

A device for breaking a power supply by means of a plug which is mounted on a terminal part connected to an electric circuit has been heretofore known (See Patent Document 1, for example).

FIGS. 4 and 5 are perspective views showing a power supply breaking device 110 which is disclosed in Patent Document 1. This device includes a plug box 120 having circuit terminals 121 which are connected to an open end of an electric circuit, and a plug body 130 which is provided on this plug box 120 so as to be displaced by a determined amount. The plug body 130 closes the electric circuit by engaging short circuit terminals 131 with the circuit terminals 121 to make a short circuit, and opens the electric circuit by detaching the short circuit terminals 131 from the circuit terminals 121 thereby to break the circuit current. The plug body 130 can be displaced with respect to the plug box 120 between a normal locking position in which the short circuit terminals 131 are engaged with the circuit terminals 121 and a temporary locking position in which the short circuit terminals 131 are detached from the circuit terminals 121.

As another conventional art, a device for connecting terminals which are connected by linkage to an operating lever, to mating terminals, by pressing them toward the mating terminals has been known (See Patent Document 2, for example).

FIGS. 6 and 7 are perspective views showing a power supply breaking device which is disclosed in Patent Document 2. This device includes a case body 201, a handle 202 having a body 210, a grip 211, and a locking part 212 provided on the body 210, an opening/closing and tripping mechanism 203, a handle locking member 215 which is arranged in the case body 201 and urged toward the body 210 in a state opposed to the body 210 to be locked to the locking part 212 thereby to prevent the handle 202 from rotating in OFF position from an ON position, and a releasing member 216 which is arranged on the case body so as to be operable from the exterior of the case body thereby to separate the handle locking member 215 from the locking part 212 of the body 210 against the urging force. When the handle 202 is rotated from the OFF position to the ON position, the locking part 212 pushes the handle locking member 215 to override it.

[Patent Document 1] Japanese Patent Publication No. 2000-82548

[Patent Document 2] Japanese Patent Publication No. 2005-209511

However, the circuit breaking device 110 disclosed in Patent Document 1 is so constructed that the circuit is broken by detaching the plug body 130 which has been engaged with the device 110. Because the plug body 130 is completely detached from the device 110, there is such anxiety that surrounding components may be damaged with drop of the plug body 130 or the plug body 130 may be lost. Moreover, because the terminal part is not completely covered, there is such anxiety that dust or extraneous materials may enter in a plug engaging part in the device, whereby the plug body 130 is unable to be engaged although tried to be engaged, or conduction error occurs even though the plug body 130 is engaged.

On the other hand, in the circuit braking device 201 disclosed in Patent Document 2, electrical connection is realized by operating the handle 215 to press a movable contact 207 against a fixed contact 206. Therefore, there is such anxiety that the contacts may be easily moved with vibration or a shock, causing conduction error or chattering. Moreover, when the device is mounted on an apparatus such as a junction board, it is necessary to fasten, with a bolt, circuit connection between the circuit breaking device and the junction board, and it is also necessary to secure the circuit breaking device by fastening it with a bolt.

SUMMARY OF THE INVENTION

An object of the invention is to provide a connector engaging structure which can assure reliable electrical connection without damaging surrounding components, and at the same time, can secure connectors without employing a bolt or the like.

The above described object of the invention can be achieved by the following structure.

A connector engaging structure, comprising:

an electrical connection box including a first connector provided with a connecting terminal;

a second connector to be engaged with the first connecter, and provided with a mating terminal to be connected to the connecting terminal;

an outer housing which houses a whole of the second connector, and is secured to the electrical connection box; and a rotatable lever which couples the second connector with the outer housing, and relatively moves the second connector to/from the first connector to connect/disconnect the connecting terminal to/from the mating terminal.

Preferably, the outer housing is secured to the first connector.

Preferably, when the second connector is relatively moved toward the first connector, the connecting terminal is connected to the mating terminal, and when the second connector is relatively moved away from the first connector, the connecting terminal is disconnected from the mating terminal.

Preferably, the outer housing includes a locked part, and the electrical connection box includes a lock part locked with the locked part.

Preferably, the second connector includes an elastically deformable arm portion having a projection, when the second connector is disengaged from the first connector, the projection is located at a first position of a side wall of the outer housing, when the second connector is engaged with the first connector, the projection is located at a second position of the side wall, the outer housing includes a locking projection located between the first position and the second position, and the locking projection projects from the side wall of the outer housing in a direction perpendicular to an engaging direction in which the second connector is to be engaged with the first connector.

Here, it is preferable that the locking projection includes a first taper face extending from the first position to an apex of the locking projection to slide the projection on the first taper face.

Here, it is preferable that the locking projection includes a second taper face extending from the second position to an apex of the locking projection to slide the projection on the second taper face.

According to the above structure, by operating the lever in a state where the outer housing which houses a whole of the second connector is secured to the electrical connection box or the first connector, the second connector can be engaged with and disengaged from the first connector. Therefore, the components will not be separated outside, when the connector is disengaged. Moreover, dust or extraneous materials will not enter into the connector engaging part, and reliable electrical connection can be assured. Further, the second connector which is the connecting plug will not be lost or need not be kept separately, and therefore, maintenance can be easily performed.

According to the above structure, the outer housing can be easily coupled to the electrical connection box or the first connector.

According to the above structure, in case where the first connector and the second connector are on halfway of the engagement, the arm part is pushed back, and so, it can be reliably recognized by a touch or by visual check that the connectors are on halfway of the engagement.

According to the above structure, when the first connector is engaged with the second connector by a determined amount, the arm part is guided along the taper face in a direction toward the position where the engagement is completed. As the results, engaging motion is accelerated thereby to facilitate the engaging operation.

According to the connector engaging structure in this invention, because the outer housing which houses a whole of the second connector is secured to the electrical connection box or the first connector, the components will not be separated from the connectors, and will not damage the surrounding components. Moreover, faulty engagement due to dust or extraneous materials is prevented beforehand, and reliable electrical connection can be assured. Further, because the connectors can be engaged with each other by operating the lever which is provided on the outer housing, it is possible to fix the connectors to each other without employing a bolt or the like.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

Now, an embodiment of the invention will be described referring to the accompanying drawings.

Figure 1:
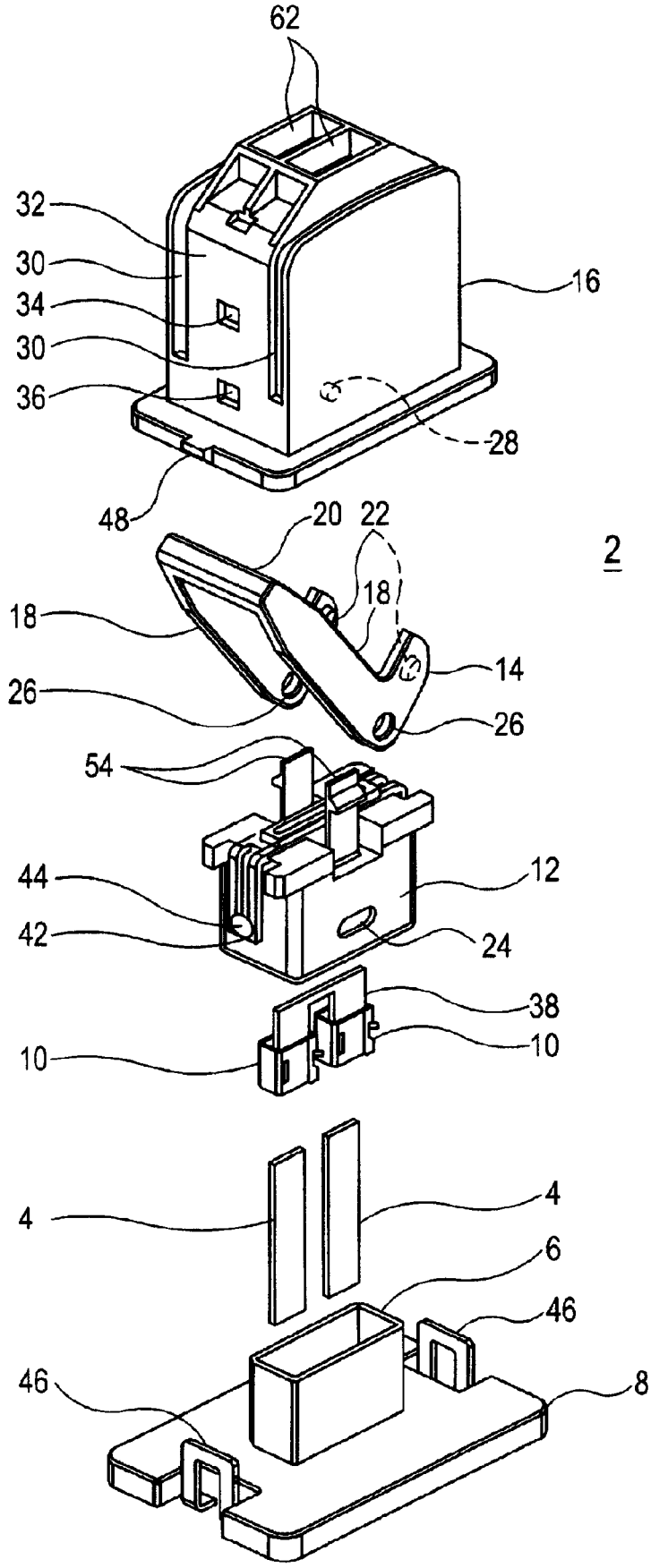
FIG. 1 is an exploded perspective view of a connector engaging structure in an embodiment according to the invention.
Figure 2B:
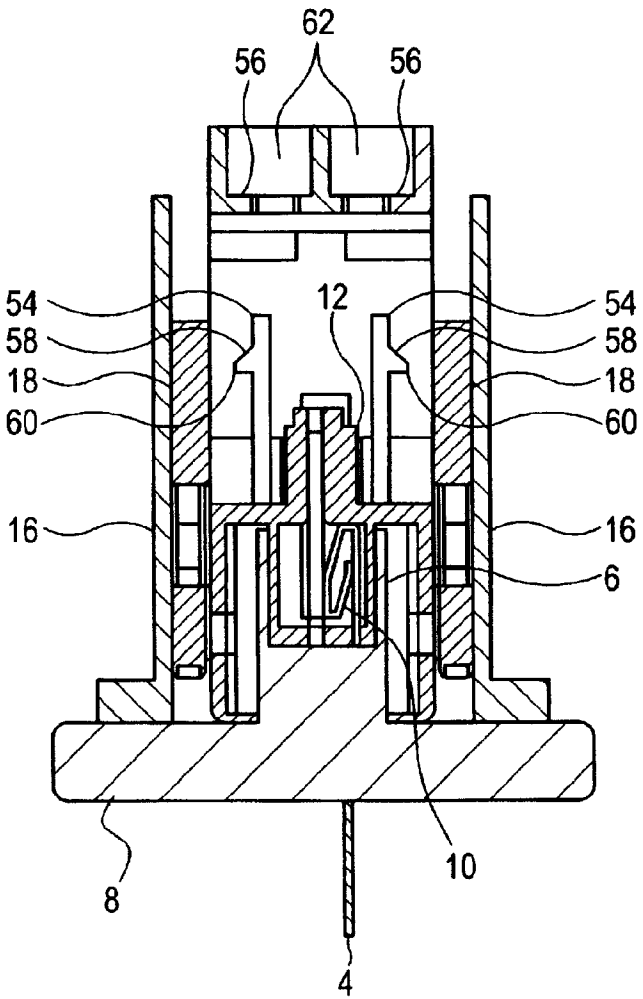
FIGS. 2A and 2B are sectional views of the connector engaging structure in FIG. 1, in an engaged state.
Figure 2A:
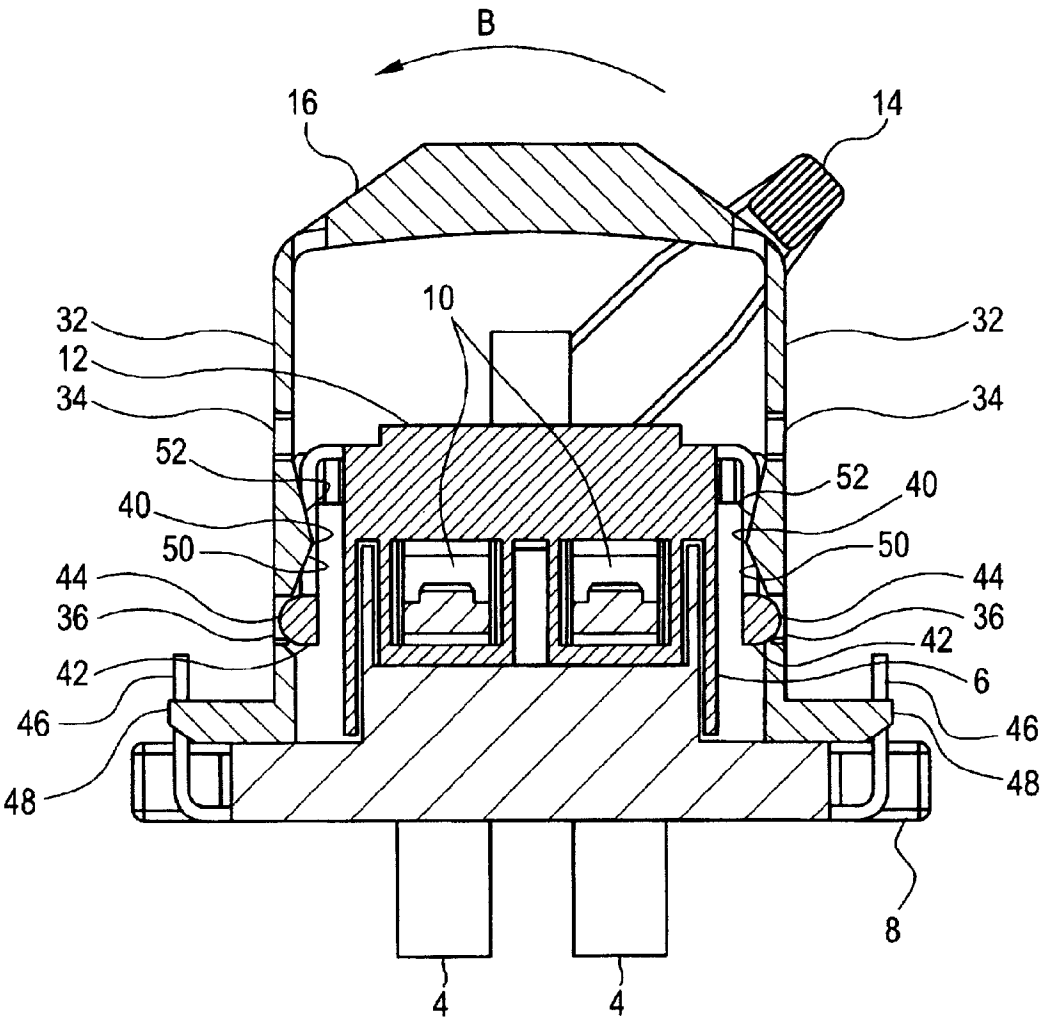
Figure 3B:
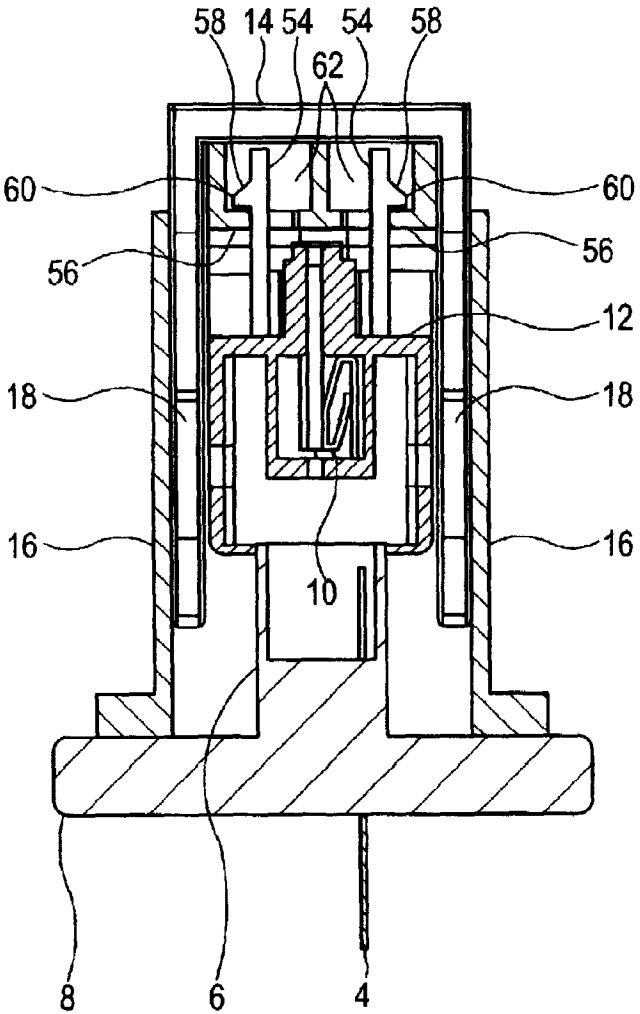
FIGS. 3A and 3B are sectional views of the connector engaging structure in FIG. 1, in a detached state.
Figure 3A:
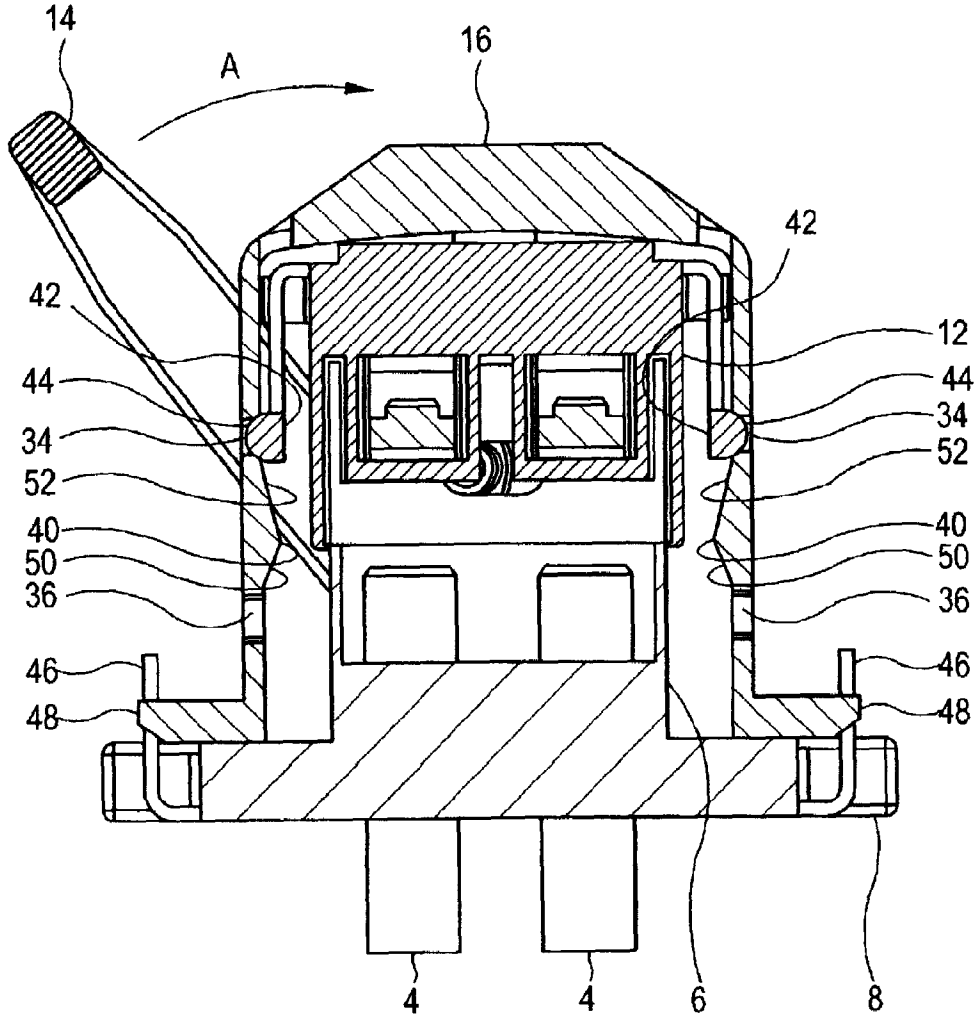
Figure 4:
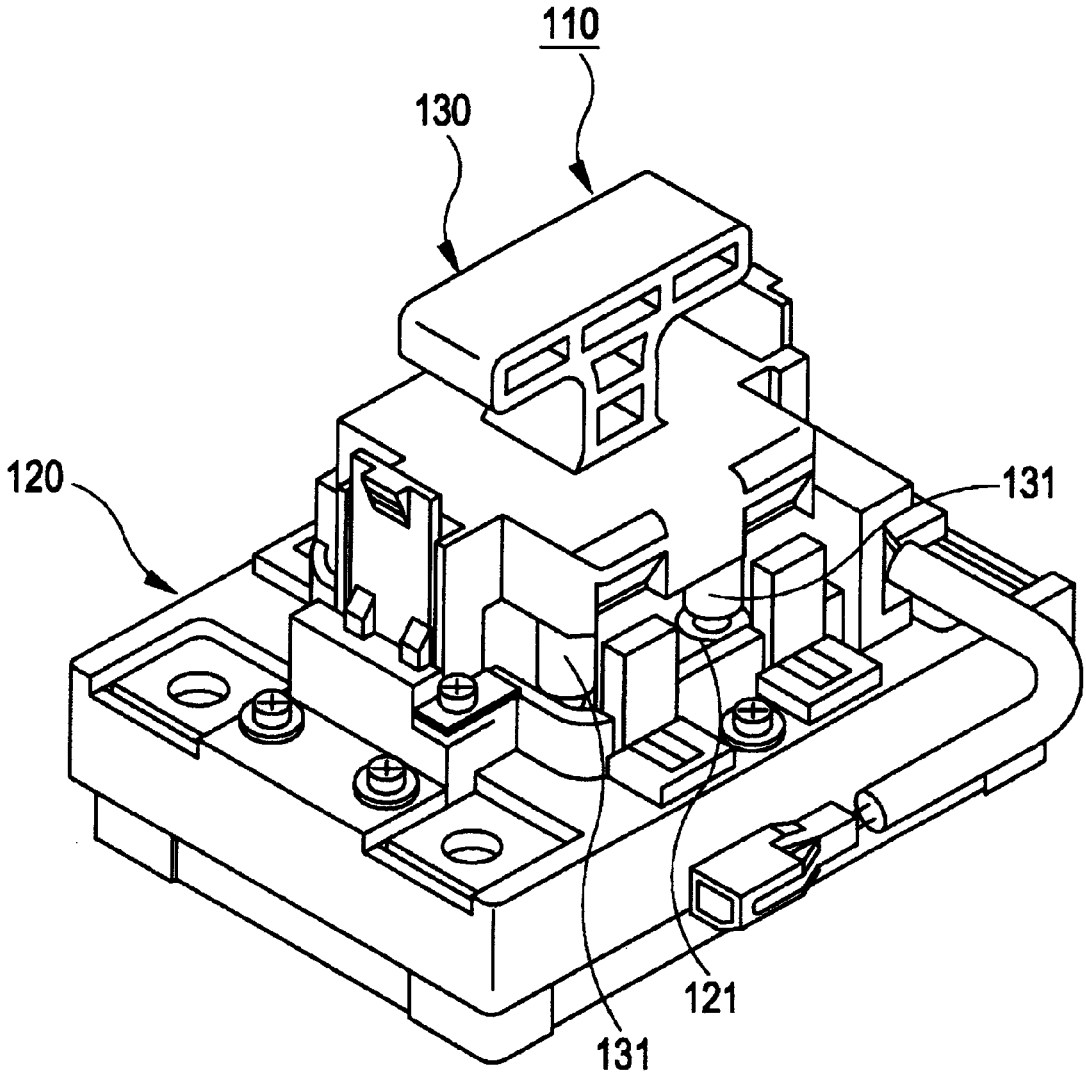
FIG. 4 PRIOR ART
FIG. 4 is a perspective view of a conventional connector engaging structure in an engaged state.
Figure 5:
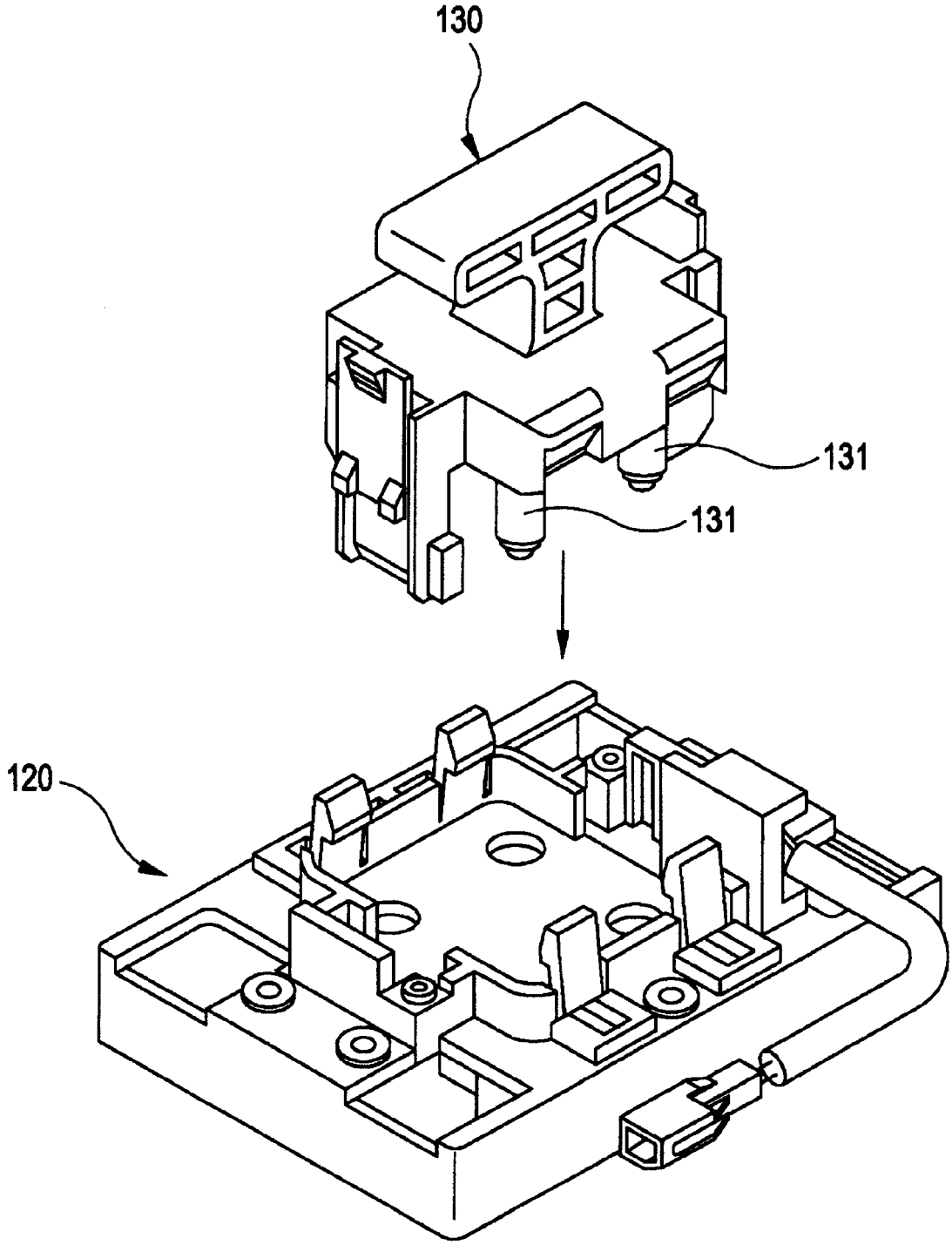
FIG. 5 PRIOR ART
FIG. 5 is a perspective view of the connector engaging structure in FIG. 4 in a detached state.
Figure 6A:
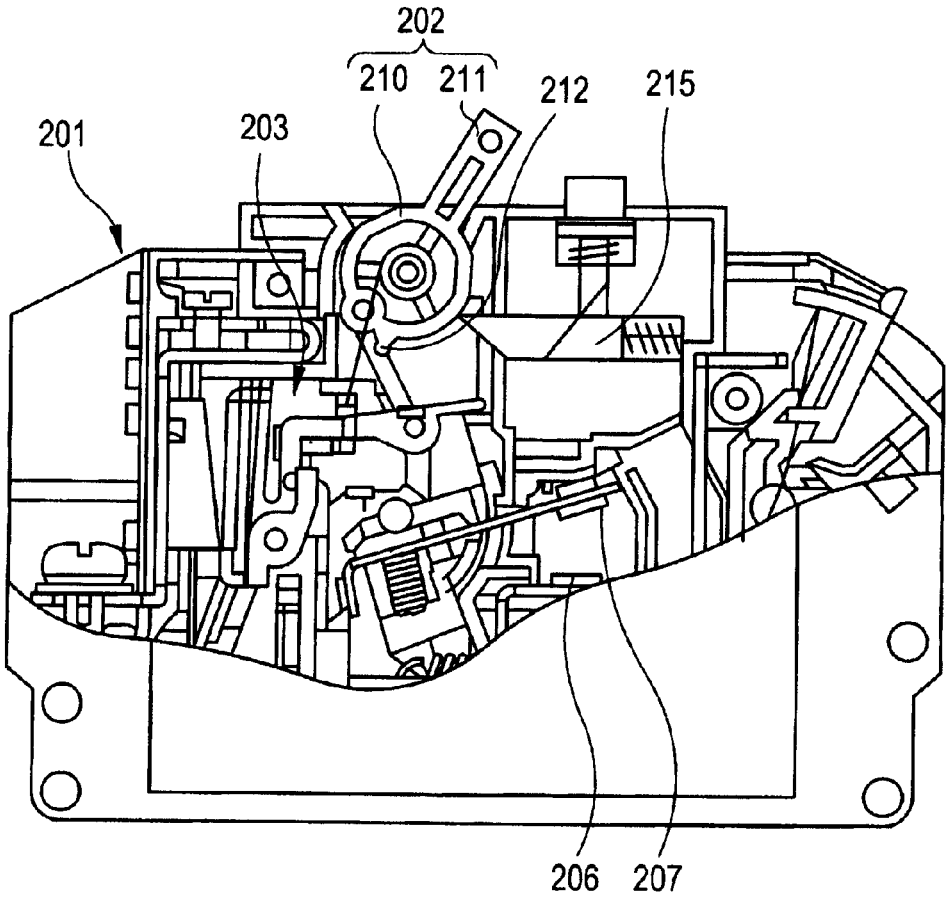
FIG. 6A PRIOR ART
FIG. 6A is a partial sectional side view of a conventional breaker when a power supply is broken.
Figure 6B:
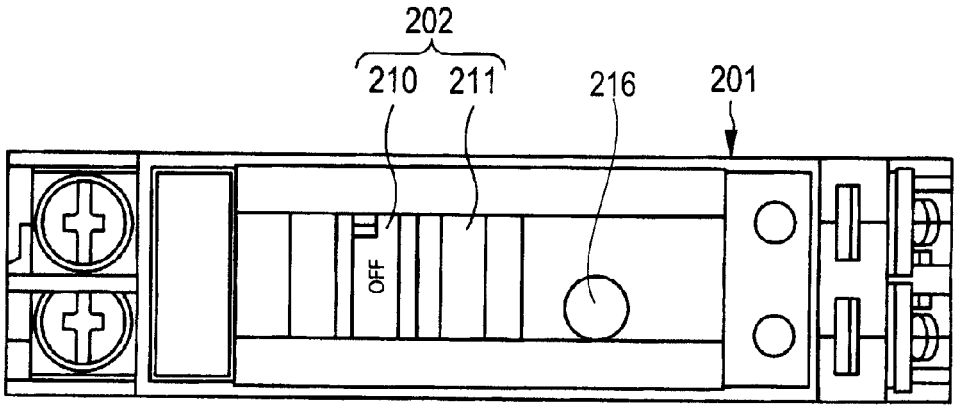
FIG. 6B PRIOR ART
FIG. 6B is a plan view of a conventional breaker when a power supply is broken.
Figure 7A:
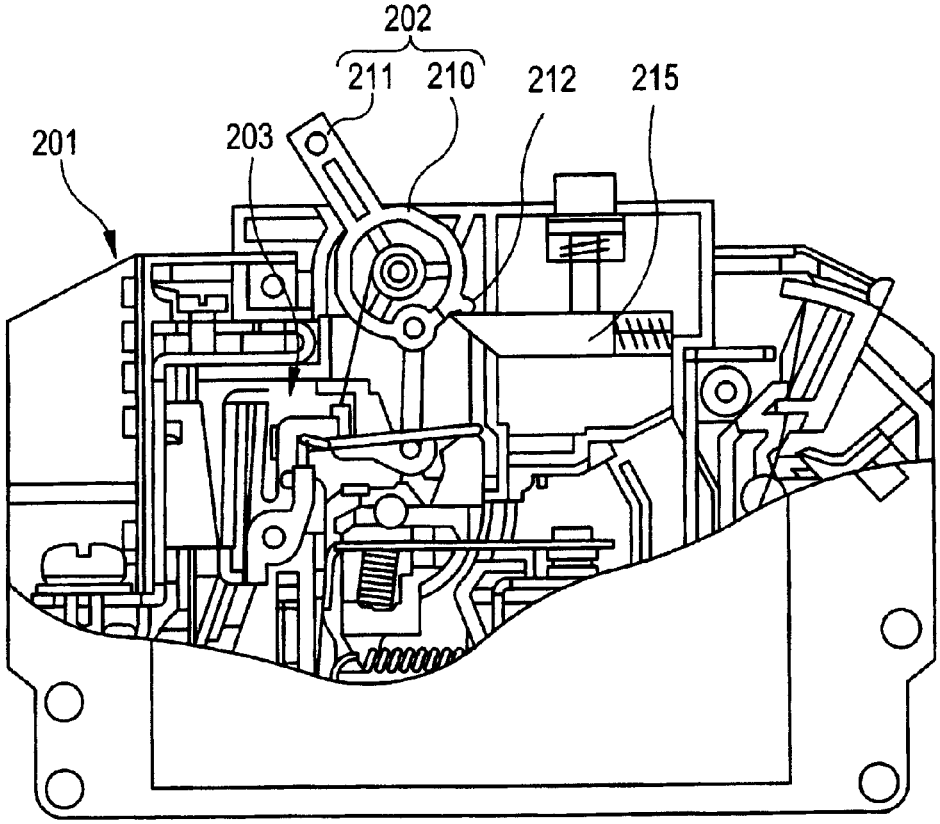
FIG. 7A PRIOR ART
FIG. 7A is a partial sectional side view of the breaker in FIG. 6A when the power supply is connected.
Figure 7B:
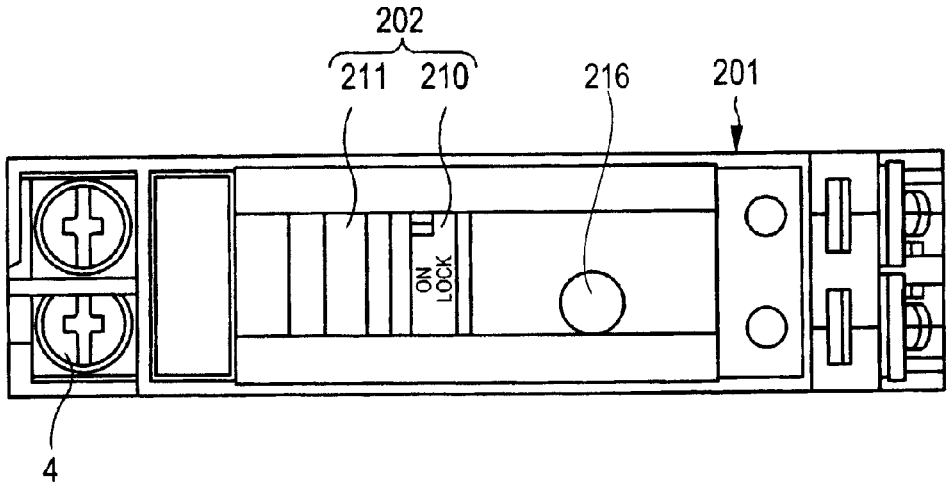
FIG. 7B PRIOR ART
FIG. 7B is a plan view of the breaker in FIG. 6B when the power supply is connected.

FIG. 1 is an exploded perspective view of a connector engaging structure in the embodiment according to the invention, FIGS. 2A and 2B are sectional views of connectors in FIG. 1 when they are engaged, and FIGS. 3A and 3B are sectional views of the connectors in FIG. 1 when they are detached from each other.

As shown in FIG. 1, a connector engaging structure 2 includes an electrical connection box 8 provided with a first connector 6 to which a pair of male terminals 4 are fitted, a second connector 12 to which a pair of female terminals 10 to be mated with the male terminals 4 are fitted, an operating lever 14 which is coupled to the second connector 12, and an outer housing 16 in which an entirety of the second connector 12 is housed and the operating lever 14 is pivotally held. It is to be noted that an entire body of the electrical connection box 8 is not shown in FIG. 1, but only a part thereof is shown.

The operating lever 14 includes an operating part 20 which is formed by coupling one ends of a pair of L-shaped side walls 18, and projections 22 which are provided on inner faces of the side walls 18 at the other ends. One of the projections 22 is adapted to be engaged with a cam groove 24 which is formed on a side face of the second connector 12. The similar cam groove 24 is formed on a side face of the second connector 12 at the opposite side which is not shown. The projections 22 of the operating lever 14 serve as working points with respect to the second connector 12, when the operating lever 14 is operated. Moreover, pivotally holding holes 26 are formed on respective outer faces of the side walls 18 at a joint part between a longer piece and a shorter piece. The outer housing 16 is provided with bosses 28 to be engaged with the pivotally holding holes 26 formed in the side walls 18 of the operating lever 14, on inner faces thereof. When the bosses 28 of the outer housing 16 are engaged with the pivotally holding holes 26 in the operating lever 14, the operating lever 14 is pivotally held by the outer housing 16 so as to rotate.

The outer housing 16 is provided with a pair of grooves 30 which serve as passages for the side walls 18 of the operating lever 14. In addition, a side wall 32 between a pair of the grooves 30 is formed with two holes 34, 36 at upper and lower positions which serve as locking positions of the second connector 12. Similar holes are also formed in the side wall 32 at the opposite side which is not shown (See FIGS. 2 and 3).

The female terminals 10 which are fitted to the second connector 12 are integrally formed by way of a connecting plate 38, and have short-circuiting function. When the second connector 12 is engaged with the first connector 6, the female connectors 10 are connected to the male terminals 4 thereby to form a short-circuit.

Moreover, a lock arm 42 in a cantilever shape which is flexible and deformable, and adapted to be engaged with a locking projection 40 (See FIG. 2) provided on an inner face of the outer housing 16 is provided on the other side face of the second connector 12. The lock arm 42 is provided with a projection 44 in a semicircular shape as a sliding element to come into slidable contact with the locking projection 40, at a tip end of the lock arm 42.

A pair of C-shaped lock parts 46 extending toward the outer housing 16 are provided in a cantilever manner on the electrical connection box 8, while a pair of locked parts 48 to be locked to the lock parts 46 of the electrical connection box 8 to secure the outer housing 16 are provided in corresponding regions of the outer housing 16. The locked parts 48 of the outer housing 16 are locked to the lock parts 46 of the electrical connection box 8 in a state where the second connector 12 and the operating lever 14 are housed in the outer housing 16, whereby the outer housing 16 is secured to the electrical connection box 8.

FIGS. 2A and 2B show the connector engaging structure 2 in a state where the connectors are engaged, in which FIG. 2A is a partial cross sectional view of the connector engaging structure 2, and FIG. 2B is a partial cross sectional view as seen in a direction displaced by 90 degree from a direction of FIG. 2A. FIGS. 3A and 3B show the connector engaging structure 2 in a state where the connectors are detached from each other, in which FIG. 3A is a partial cross sectional view of the connector engaging structure 2, and FIG. 3B is a partial cross sectional view as seen in a direction displaced by 90 degree from a direction of FIG. 3A.

As shown in FIGS. 2A and 2B, the locked parts 48 of the outer housing 16 are locked to the lock parts 46 of the electrical connection box 8, whereby the outer housing 16 which houses the second connector 12 is secured to the electrical connection box 8. While the first connector 6 and the second connector 12 are properly engaged with each other, the male terminals 4 are electrically connected to the female terminals 10, and an electric circuit inside the electrical connection box 8 is short-circuited by means of the female terminals 10 which have the short-circuiting function. The projections 44 of the lock arms 42 of the second connector 12 are respectively engaged with the holes 36 at the lower position on the side faces 32 of the outer housing 16 thereby to secure the first connector 6 at the engaged position.

The operating lever 14 is positioned at a fixed position as shown in FIG. 2A. When the operating lever 14 is rotated in a direction of an arrow mark B from the fixed position, a force which presses the operating lever 14 acts from the projections 22 provided on the side walls 18 of the operating lever 14 to the cam grooves 24 of the second connector 12, in a state where the projections 22 are engaged with the cam grooves 24. Then, the force is applied to the second connector 12 in a direction of detaching, and the projections 44 of the lock arms 42 of the second connector 12 are removed from the holes 36 at the lower position.

Then, the second connector 12 is displaced so as to be detached, following the rotation of the operating lever 14. On this occasion, each of the lock arms 42 is flexed toward a side face of the connector, and the projection 44 arrives at an apex of the locking projection 40 of the outer housing 16, while the projection 44 is guided along a lower taper face 50 of the locking projection 40. When the projection 44 has overridden the apex of the locking projection 40, the projection 44 is guided along an upper taper face 52 by action of a restoring force of the lock arm 42, whereby detaching motion is accelerated, and the second connector 12 is detached from the first connector 6.

When the projection 44 of the lock arm 42 is engaged with the hole 34 at the upper position, detachment of the second connector 12 is completed, and the electric circuit inside the electrical connection box 8 is opened. The second connector 12 can be easily detached from the first connector 6, by synergic action of the rotation of the operating lever 14 and the restoring force of the lock arms 42.

In FIGS. 3A and 3B, the connectors 6 and 12 are completely detached from each other. At a time when the connectors are detached, the operating lever 14 is in a released position as shown in FIG. 3A, in which the second connector 12 is detached from the first connector 6, and connection between the female terminals 10 and the male terminals 4 is released. In this state, detachment securing pieces 54 extending upward from the second connector 12 are locked to stepped parts 56 provided on the outer housing 16, whereby the second connector 12 is secured in the state where it is completely detached. The detachment securing pieces 54 are respectively provided with lock portions 60 having taper faces 58, at their distal ends. The detachment securing pieces 54 are flexed and deformed, while the taper faces 58 are guided along the stepped parts 56 with upward movement of the second connector 12, whereby the lock portions 60 are engaged with the stepped parts 56.

In order to release the lock between the lock portions 60 and the stepped parts 56, fingers are inserted into upper openings 62 formed in the outer housing 16, and the detachment securing pieces 54 are flexed so as to approach each other. It is possible to release the lock by employing a jig instead of the fingers. In a state where the lock between the lock portions 60 and the stepped parts 56 is released, the operating lever 14 is rotated in a direction of an arrow mark A, whereby the second connector 12 moves in a direction of approaching the first connector 6 following the rotation of the operating lever 14, in a reverse motion to the releasing motion.

On this occasion, the lock arms 42 are flexed and deformed toward the connector, and the projections 44 are detached from the holes 34 at the upper position to be guided along the upper taper faces 52 of the locking projections 40. When the projections 44 of the lock arms 42 arrives at the lower taper faces 50 of the locking projections 40, the projections 44 are unlikely to be released due to the restoring forces of the lock arms 42, but to the contrary, engaging motion is accelerated. Then, the operating lever 14 is rotated to the position as shown in FIGS. 2A and 2B in a state where the restoring forces of the lock arms 42 are added, whereby downward movement of the second connector 12 is completed, and its engagement with the first connector 6 is completed.

In case where the engaging motion by the operating lever 14 is interrupted while the projections 44 of the lock arms 42 are in contact with the upper taper faces 52 of the locking projections 40, the second connector 12 is returned in a direction of detaching by the restoring forces of the lock arms 42. Therefore, it can be easily recognized by a touch or by visual check that the connectors are on halfway of the engagement.

The invention is not limited to the above described embodiment, but all modifications can be made within a concept of the invention. For example, although the outer housing 16 is secured to the electrical connection box 8 in the above described embodiment, the outer housing 16 may be secured to the first connector 6.

What is claimed is:

1. A connector engaging structure, comprising:

an electrical connection box including a first connector provided with a connecting terminal;

a second connector to be engaged with the first connecter, and provided with a mating terminal to be connected to the connecting terminal;

an outer housing which covers an entirety of the second connector, and is detachably secured to the electrical connection box by locking parts, the outer housing covering the first connector with the electrical connection box when the outer housing is secured to the electrical connection box; and a rotatable lever which includes a first engagement portion engaged with an inner surface of the outer housing serving as a fulcrum, and a second engagement portion engaged with the second connector serving as a load point so as to couple the second connector with the outer housing, and relatively moves the second connector to/from the first connector to connect/disconnect the connecting terminal to/from the mating terminal.

2. The connector engaging structure as claimed in claim 1, wherein the outer housing is secured to the first connector.

3. The connector engaging structure as claimed in claim 1, wherein when the second connector is relatively moved toward the first connector, the connecting terminal is connected to the mating terminal; and wherein when the second connector is relatively moved away from the first connector, the connecting terminal is disconnected from the mating terminal.

4. The connector engaging structure as claimed in claim 1, wherein the outer housing includes a locked part; and wherein the electrical connection box includes a lock part locked with the locked part.

5. The connector engaging structure as claimed in claim 1, wherein the second connector includes an elastically deformable arm portion having a projection;

wherein when the second connector is disengaged from the first connector, the projection is located at a first position of a side wall of the outer housing;

wherein when the second connector is engaged with the first connector, the projection is located at a second position of the side wall;

wherein the outer housing includes a locking projection located between the first position and the second position; and wherein the locking projection projects from the side wall of the outer housing in a direction perpendicular to an engaging direction in which the second connector is to be engaged with the first connector.

6. The connector engaging structure as claimed in claim 5, wherein the locking projection includes a first taper face extending from the first position to an apex of the locking projection to slide the projection on the first taper face.

7. The connector engaging structure as claimed in claim 5, wherein the locking projection includes a second taper face extending from the second position to an apex of the locking projection to slide the projection on the second taper face.

8. The connector engaging structure as claimed in claim 1, wherein the first connector is further provided with another connecting terminal, wherein the second connector is further provided with another mating terminal which is electrically connected with the mating terminal, and wherein when the second connector is engaged with the first connector, the mating terminal and the other mating terminal electrically connect the connecting terminal and the other connecting terminal.

9. The connector engaging structure as claimed in claim 1, wherein the connector engaging structure is in a first state when the second connector is engaged with the first connector, wherein the connector engaging structure is in a second state when the second connector is disengaged from the first connector, and wherein the outer housing is secured to the electrical connection box when the connector engaging structure is in both the first and second state.

10. The connector engaging structure as claimed in claim 9, wherein the outer housing and the first connector are stationary relative to each other while the connector engaging structure is being changed from the first state to the second state.

11. The connector engaging structure according to claim 1, wherein the locking parts comprise a pair of C-shaped lock parts provided on the electrical connection box, and a pair of locked parts provided on the outer housing to be respectively locked with the pair of C-shaped lock parts.

12. The connector engaging structure according to claim 11, wherein each of the pair of C-shaped lock parts has a cantilever structure.

* * * * *